US005348455A

United States Patent [19]

Herrick et al.

[11] Patent Number: 5,348,455

[45] Date of Patent: Sep. 20, 1994

[54] ROTARY COMPRESSOR WITH ROTATION PREVENTING PIN

[75] Inventors: Todd W. Herrick, Tecumseh; Edwin L. Gannaway, Adrian, both of Mich.

[73] Assignee: Tecumseh Products Company, Tecumseh, Mich.

[21] Appl. No.: 67,426

[22] Filed: May 24, 1993

[51] Int. Cl.[5] ..... F01C 1/02

[52] U.S. Cl. ..... 418/63; 418/248

[58] Field of Search ..... 418/54, 63, 64, 65, 418/66, 67, 248

[56] References Cited

U.S. PATENT DOCUMENTS

| | | | |
|---|---|---|---|
| 879,213 | 2/1908 | Tew . | |
| 1,633,056 | 6/1927 | Wishart . | |
| 1,705,653 | 3/1929 | Weber . | |
| 1,817,735 | 8/1931 | Clark . | |
| 2,010,761 | 8/1935 | Hazlinger | 103/132 |
| 2,476,383 | 7/1949 | Porteous | 418/63 |
| 2,800,274 | 7/1957 | Markaroff | 230/147 |
| 2,859,911 | 11/1958 | Reitter | 230/147 |
| 3,554,676 | 1/1971 | Porteous | 418/61 |
| 3,882,827 | 5/1975 | Williams | 122/8.27 |
| 4,265,605 | 5/1981 | Ito | 418/63 |
| 4,508,495 | 4/1985 | Monden | 415/175 |
| 5,129,799 | 7/1992 | Scheldorf | 418/63 |

FOREIGN PATENT DOCUMENTS 1317572 3/1963 France .

*Primary Examiner*—Richard A. Bertsch
*Assistant Examiner*—Charles G. Freay
*Attorney, Agent, or Firm*—Baker & Daniels

[57] ABSTRACT

A rotary compressor including an orbiting piston is disposed within a cylinder bore. A drive shaft with an attached eccentric causes the piston to orbit within the cylinder block. Rotation of the piston is prevented by a pin radially disposed on the piston and slidably engaged through a recess in the cylinder bore. A plastic pinion is interfit about the radially outward end of the pin and disposed within the recess to prevent piston rotation and reduce re-expansion volume.

9 Claims, 2 Drawing Sheets

ROTARY COMPRESSOR WITH ROTATION PREVENTING PIN

BACKGROUND OF THE INVENTION

This invention pertains to hermetic rotary compressors for compressing refrigerant in refrigeration systems such as refrigerators, freezers, air conditioners and the like. In particular, this invention relates to reducing frictional loading of the sliding vanes on the piston.

In general, prior art rotary hermetic compressors comprise a housing in which are positioned a motor and compressor cylinder. The motor drives a crankshaft for revolving a rotor or roller (piston) inside the cylinder. One or more sliding vanes are slidably received in slots located through the cylinder walls. The vanes, cooperating with the rotor and cylinder walls, provide the structure for compressing refrigerant within the cylinder bore.

The operating parts of rotary hermetic compressors are machined to extremely close tolerances and the surfaces of the parts are finished to a high degree in order to prevent leakage and provide a very efficient compressor. Preventing leakage of refrigerant from high pressure areas to low pressure areas is of main concern to increase compressor efficiency.

One of the problems encountered in prior art hermetic compressor arrangements has been high frictional loading between the vane tips and the rolling piston, and between the piston and the cylinder walls. The vane necessarily has to be highly loaded against the piston to prevent leaks. At times, insufficient oil reaches the critical wear areas of the vane tips and piston, thereby increasing the wear rate of both. A reduction in the frictional loading on the vane tips would reduce wear and increase compressor efficiency.

Further, the rolling of the piston beneath the vane tip causes worn areas on the piston circumference. These worn areas lead to the creation of leak paths between the piston and cylinder wall during compressor operation. There is a need for a compressor that exhibits a high resistance to piston wear caused by the engaging vanes sealing.

Normally, the refrigerant within the compressor system is in the gaseous state. At times, the system pressure creates an overpressure condition which changes the refrigerant from gas to liquid. When the compressor encounters refrigerant, this is called slugging. Slugging of liquid refrigerant within a compressor can damage the relatively fragile discharge and suction valves along with other compressor components.

Some prior art hermetic compressors have not included mechanisms for protection from slugging conditions. One such compressor is that shown in U.S. Pat. No. 2,800,274. It shows a piston that operates within a cylinder bore having a vane pivotable attached to the piston. The vane prevents piston rotation. Because of this construction, during a slugging condition the vane does not have the ability to separate from the piston and connect together suction and discharge pressure areas. This may cause liquid to forcibly pass by the discharge valve to an extent that it may damage the valve and other compressor parts. An important design consideration for a compressor is to operate without failure, during a momentary slugging condition.

The present invention is directed to overcoming the aforementioned problems associated with rotary compressors, wherein it is desired to provide a pin inserted into the piston to prevent piston rotation and cause the vane to engage the piston at substantially one point, thereby reducing frictional loading and wear about the circumference of the piston.

SUMMARY OF THE INVENTION

The present invention overcomes the disadvantage of the above described prior art rotary hermetic compressors by providing a rotation preventing pin attached to the compressor rolling piston to reduce wear.

Generally, the invention provides a rotary compressor including a cylinder block with a piston located therein to compress fluid. The piston orbits within a bore within the cylinder block to compress fluid. The piston is prevented from rotating by a radially attached pin that slides within a recess in the cylinder block. A pinion member, disposed within the recess in the cylinder block, includes a bore in which the pin slides. The pinion holds the pin in place, prevents pin contact with the cylinder block, and reduces re-expansion volume.

An advantage of the rotary compressor of the present invention is the provision for a simple and inexpensive rotation prevention means that reduces vane and piston wear. The pin prevents substantial piston rotation, thereby causing the vane and piston to contact continuously at substantially the same area on the piston. Because the piston does not rotate beneath the vane, any piston wear caused by the vane will be located at one spot (i.e. the contact point). Since this wear area is located beneath the vane, the vane will maintain a high pressure seal between suction and discharge pressure areas on the piston under normal conditions. Furthermore, since this possible wear point is always beneath the vane and not on the line contact between the piston cylinder walls, pressure leaks between high and low pressure areas are reduced.

Another advantage of the rotary compressor of the present invention is the provision of a reliable and easily manufactured mechanism for rotation prevention of the piston. The pin and pinion construction is more efficient than other rotation prevention mechanisms because it contains less mass to move, as compared to an Oldham ring rotation prevention means. The pinion is preferably made from plastic or other lightweight material.

A further advantage of the present invention is the provision for slugging control by allowing the vane to radially separate from the orbiting piston during a slugging condition. The separation of the vane from the piston will connect the discharge and suction spaces together and equalize pressure, thereby preventing damage to the compressor parts.

The invention, in one form thereof, provides a rotary compressor with a housing in which a cylinder block is disposed. The cylinder block has a bore having an area at suction pressure and an area at discharge pressure. A piston engages the sidewalls of the bore to compress fluid and separate the discharge and suction pressure areas. The cylinder block also includes a vane slidable therein to further separate the discharge pressure area from the suction pressure area, with the vane in sealing contact with the piston. A drive mechanism is disposed within the housing for actuation of the piston within the bore to compress fluid.

A pinion is disposed in a recess open to the bore. The pinion includes an anti-rotation attachment pin slidable in either the pinion or the piston, with the pin attached to the other of the pinion or piston so that rotation of the piston is prevented. The recess for the pinion and attachment pin is located in the suction pressure area so that re-expansion volume is reduced.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
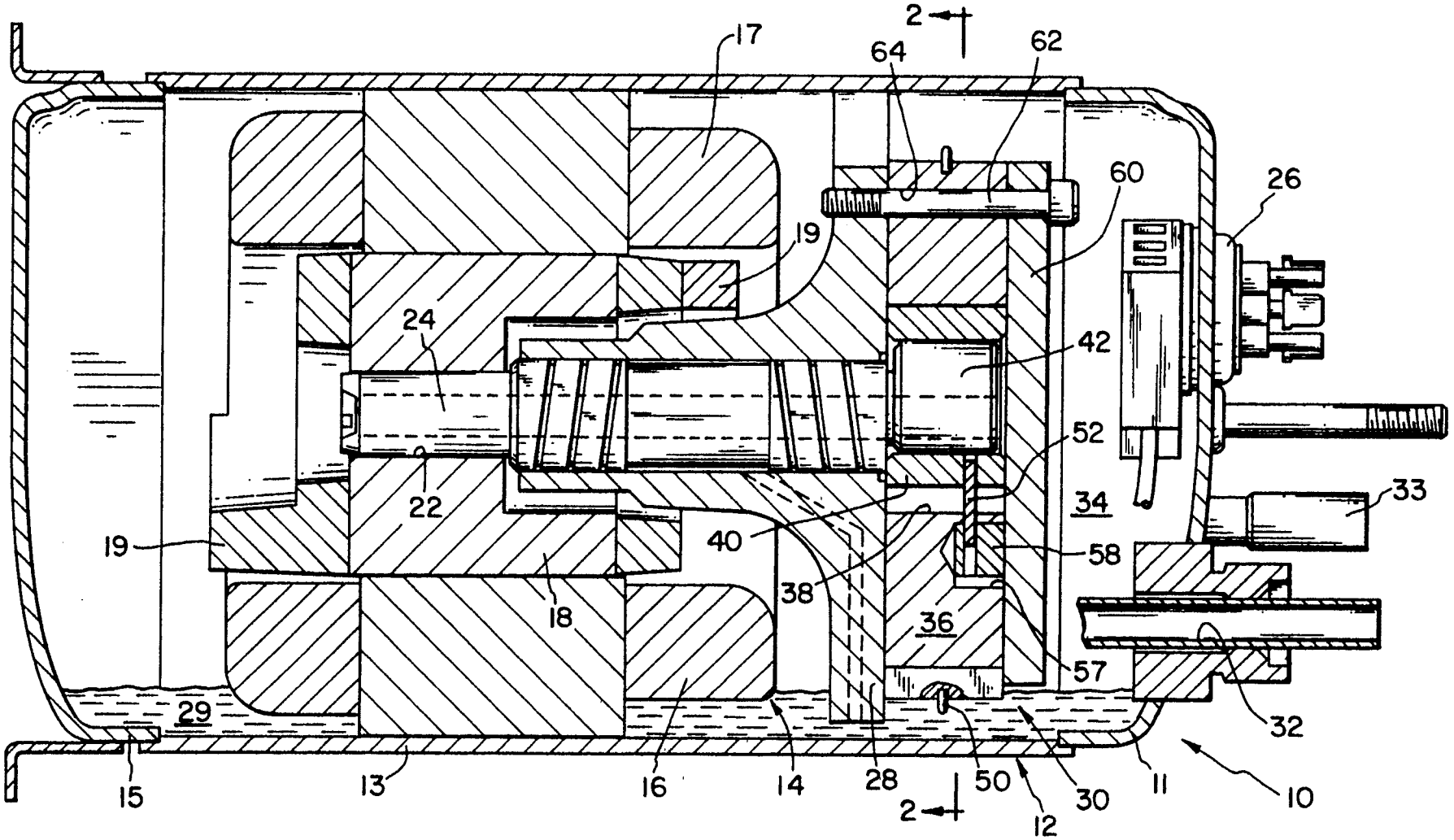
FIG. 1 is a sectional view of the compressor of the present invention.

In an exemplary embodiment of the invention as shown in the drawings and in particular by referring to FIG. 1, a compressor 10 is shown having a housing designated at 12. The housing has a top portion 11, a central portion 13, and a bottom portion 15. The three housing portions are hermetically secured together as by welding or brazing.

Located inside hermetically sealed housing 12 is a motor generally designated at 14 having a stator 16 and rotor 18. The stator 16 is provided with windings 17. The stator 16 is secured to housing 12 by an interference fit such as by shrink fitting. The rotor 18 has a central aperture 22 provided therein into which is secured a drive shaft 24 by an interference fit. A counterweight 19 is attached to rotor 18. A terminal cluster 26 is provided on a top portion 11 of compressor 10 for connecting motor 14 to a source of electrical power. Frame member 28 is attached to housing 12 above motor 14 by an interference fit or welding. An oil sump 29 is located in a portion of housing 12 to provide a supply of lubricant to compressor mechanism 30.

Compressor mechanism 30 is attached to both frame 28 and housing 12. A refrigerant discharge tube 32 extends through the top of housing 12 and has an end thereof extending into the interior 34 of compressor housing 12 as shown in FIG. 1. Discharge tube 32 is sealingly connected to housing 12 by soldering. Similarly, a suction tube 33 extends into the interior of compressor housing (FIG. 1).

Figure 2:
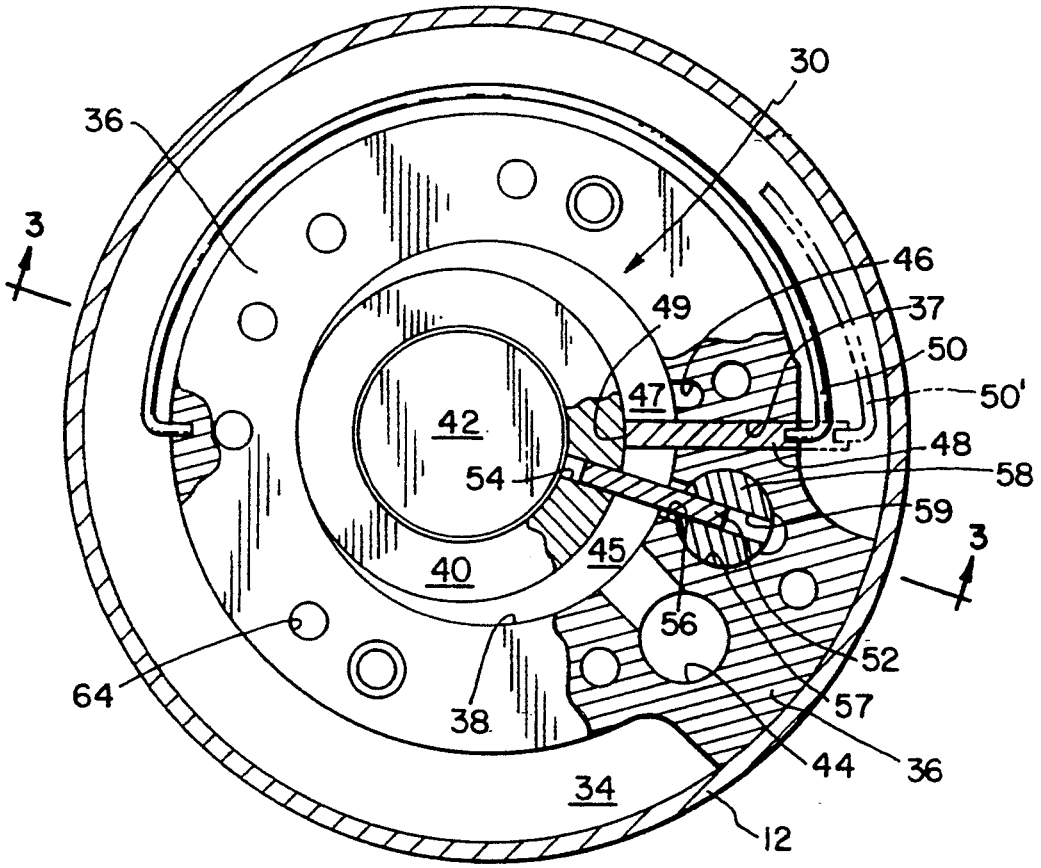
FIG. 2 is a sectional view of the compressor taken along line 2—2 of FIG. 1.

As shown in FIG. 2, compressor mechanism 30 comprises a cylinder block 36 having a bore 38 in which an annular piston 40 is disposed. Located within piston 40 is an eccentric 42 attached to drive shaft 24. Alternatively, eccentric 42 and drive shaft 24 may comprise a one-piece member.

As shown in FIG. 2, within cylinder block 36 is a suction port 44 connecting with a suction pressure area 45 and a discharge port 46 communicating with a discharge pressure area 47. Suction port 44 is in communication with suction tube 33, but not illustrated in the drawings, to help increase the clarity of the invention. Discharge port 46 is in communication with the interior 34 of compressor 10 via a discharge valve (not shown). Interior 34 is further in communication with an associated refrigerant system (not shown) by discharge tube 32.

FIG. 2 shows piston 40 at approximately half way through an orbiting compression stroke. A vane 48 is interfit and slides within a groove 37 of cylinder block 36. Vane 48, having a tip 49, sealingly engages piston 40 to separate suction pressure area 45 from discharge pressure area 47. A C-shaped spring 50 engages vane 48 and biases wrap tip 49 to piston 40. During other portions of the compression cycle, vane 48 and spring 50 may be in the phantom position as shown by reference numeral 50'.

Figure 3:
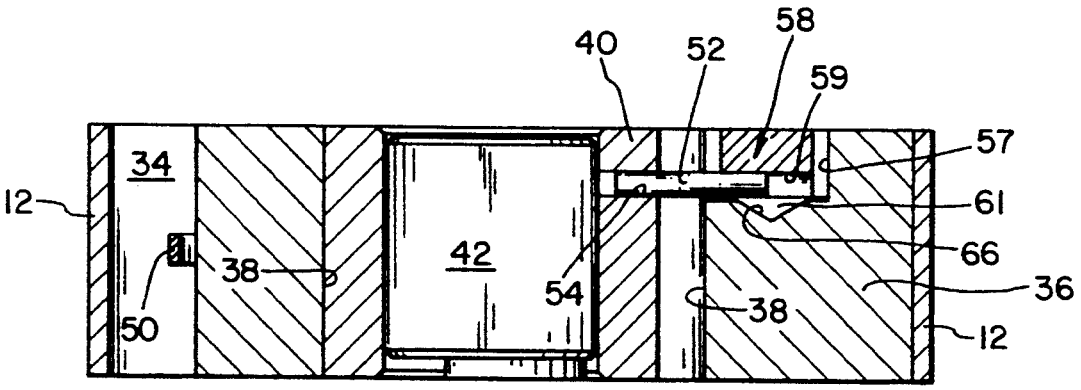
FIG. 3 is a sectional view of the compressor taken along line 3—3 of FIG. 2.

The rotation prevention means of the present invention, as shown in FIGS. 2 and 3, includes a radial attachment pin 52 fixedly disposed within a bore 54 in piston 40. Alternatively, pin 52 may attach to pinion 58, and be slidably received within bore 54. Pin 52 is constructed from hardened steel but may alternatively be constructed from other durable alloys. Pin 52 is located within opening 56 by a plastic pinion 58 disposed within blind bore or recess 57. As shown in FIG. 2, pin 52 slides within an opening 56 into a recess 57 within cylinder block 36. Pinion 58 is preferably constructed from nylon, but may be constructed from other plastics.

Pinion 58 includes a bore 59 in which pin 52 slides. The pinion 58 rotates within recess 57 preventing pin 52 from contacting cylinder block 36. To reduce friction and maintain its location during rotation, pinion 58 includes a cone shaped bottom surface 61 as shown in FIG. 3. Recess 57, likewise, has a corresponding cone shaped portion 66 (FIG. 3).

Pin 54 and opening 56 are located between suction port 44 and vane 48, so that opening 56 and recess 57 at this location are only exposed to suction pressure. By locating the recess 57 in the suction pressure side of the compressor, possible re-expansion volume within recess 57 and pinion 58 does not communicate with refrigerant at discharge pressure.

As shown in FIG. 1, cylinder mechanism 30 is located between end plate 60 and frame member 28. End plate 60 is attached to frame member 28 by a plurality of bolts 62 threaded through bolt holes 64 in cylinder block 36.

In operation, motor 14 rotates drive shaft 24 thereby causing eccentric 42 to move within cylinder bore 38. The orbiting of eccentric 42 within bore 38 causes associated piston 40 to orbitally contact the side wall of bore 38. Pin 52, disposed within piston 40, prevents piston 40 from rotating but causes a substantially orbiting motion of piston 40 within bore 38 since pin 52 is constrained to slide within bore 59 and opening 56. As piston orbits within bore 38, pin 52 reciprocates within pinion 58 while preventing substantial piston rotation.

Piston 40 orbits in cylinder bore 38 while maintaining a substantially constant angular position with respect to the cylinder bore 38.

During operation, pinion 58 rotates slightly within recess 57 due to the geometry of eccentric 42 and the distance between piston 40 and the opening 56 in cylinder block 36. This small rotation prevents high shear loads on pin 52. As piston 40 orbits, vane 48 will reciprocate within groove 37 and at all times maintains contact of vane tip 49 with piston 40. Spring 50 biases vane 48 into contact with piston 40.

The orientation of pin 52 minimizes rubbing and sliding friction against vane 48 and piston 40 as compared to previous compressors. The reduction of friction reduces frictional heating and increases the mechanical efficiency of compressor 10.

Upon activation, fluid at suction pressure is pulled from suction port 44 into suction pressure space 45. As piston 40 orbits within bore 38, fluid trapped within suction pressure space 45 is compressed and forced around piston 40 into discharge pressure space 46. As a contact point between piston 40 and cylinder bore 38 approaches discharge port 46, the fluid trapped between bore 38 and piston 40 is further compressed and is urged out of cylinder bore 38 into discharge port 46. As discharge pressure space 47 closes, because of piston 40 movement, vane 48 slides back within groove 37 closer to phantom position 50'. At this time, pin 52 is almost at its maximum radial position with respect to insertion within bore 59 in pinion 58. Compressed fluid exits discharge port 46, past a discharge valve (not shown) into interior 34 of compressor 10, and then travels out through discharge tube 32.

The wear on piston 40 is localized to substantially the portion in contact with vane tip 49. Because of the constant angular position of piston 40 within cylinder 36, vane tip 49 will wear at only one place on piston 40. This localization of wear reduces the likelihood of any leak paths forming about the circumference of piston 40. Further, the piston wear localized beneath vane tip 49 will not produce vane bounce during compressor operation since vane 48 is not constantly moving from worn to unworn piston surfaces.

During manufacturing of compressor 10, automatic control of the set point between piston 40 and cylinder bore 38 is possible with the one piece drive shaft 24 and eccentric 42. Positive location of cylinder block 36 onto frame 28 and attachment by bolts 62 permits accurate location of the set point.

By using the hardened steel pin 52 to prevent substantial rotation of piston 40 as compared to an Oldham ring assembly, compressor 10 is made more efficient because less mass is moving via the force from motor 14.

Additionally, by having vane 48 biasedly engaged to piston 40 by spring 50, slugging protection is assured. Vane 48 is biased toward piston 40 to an extent to seal between discharge pressure area 47 and suction pressure area 45, but yieldable to an extent to disengage from the piston 40 during compression of liquid.

During a slugging condition, liquid fluid would be contained within either suction pressure chamber 45 or discharge pressure 47. At this time, the relatively large pressure of the liquid under compression will lift vane 48 from piston 40 creating an escape path for the liquid, thereby lowering the pressure experienced by the valves. After system conditions have changed, spring 50 biases vane 48 back into engagement with piston 40 and normal operation of compressor 10 continues.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rotary compressor comprising:

a housing;

a cylinder block disposed with said housing, said cylinder block having a cylinder bore with a sidewall, said cylinder bore having an area at suction pressure and an area at discharge pressure, a piston located within and engaging the sidewall of said cylinder bore to compress fluid and separate said areas at discharge pressure and suction pressure areas, said cylinder block including a vane slidable therein to further separate said discharge pressure area from said suction pressure area, said vane is biased contact with said piston, said cylinder block having a recess open to said cylinder bore;

a drive mechanism disposed within said housing for actuation of said piston within said cylinder bore to compress fluid;

a pinion disposed within said recess, said pinion having an attachment pin slidable in one of said pinion and said piston, said pin attached to the other of said pinion and said piston whereby rotation of said piston is prevented; and a suction port in communication with said cylinder bore, said recess located between said vane and said suction port whereby re-expansion volume is reduced.

2. The compressor of claim 1 in which said pin is constructed of hardened steel.

3. The compressor of claim 1 in which said pinion is constructed of plastic.

4. The compressor of claim 1 in which said vane is biased toward said piston to an extent to seal between said discharge pressure area and said suction pressure area, and yieldable enough to release from said piston during a slugging condition.

5. A rotary compressor comprising:

a housing;

a cylinder block having a cylinder bore with a sidewall, said cylinder bore having an area at suction pressure and an area at discharge pressure, a piston located within and engaging the sidewall of said cylinder bore to compress fluid and separate said discharge pressure area and said suction pressure area, said cylinder block including a vane slidable therein to further separate said discharge pressure area from said suction pressure area, said vane in slidable contact with said piston, said cylinder including a recess open to said cylinder bore;

a drive means having a crankshaft and an eccentric, said drive means disposed within said housing for moving said piston with said cylinder bore to compress fluid;

a pinion disposed within said recess, said pinion having an aperture;

a rotation preventing pin attached to said piston and slidable within said pinion aperture for preventing rotation of said piston within said cylinder bore whereby during compressor operation said piston is prevented from rotating beneath said vane so that said vane contacts a small localized area of said piston; and a suction port in communication with said cylinder bore and said suction pressure area, said pin and said pinion located between said vane and said suction port.

6. The compressor of claim 4 in which said recess is a blind bore having a passageway communicating with said bore.

7. The compressor of claim 4 in which said vane is biased toward said piston to an extent to seal between said discharge pressure area and said suction pressure area, and yieldable to an extent to discharge from said piston during compression of liquid.

8. The compressor of claim 5 in which said pin is constructed of hardened steel.

9. The compressor of claim 5 in which said pinion is constructed of plastic.

* * * * *